US005809387A

United States Patent [19]

Takeuchi et al.

[11] Patent Number: 5,809,387

[45] Date of Patent: Sep. 15, 1998

[54] IMAGE FORMING APPARATUS EMPLOYING AN INTERMEDIARY TRANSFER MEMBER

[75] Inventors: Akihiko Takeuchi, Susono; Toshiaki Miyashiro, Shizuoka-ken; Naoki Enomoto, Susono; Takaaki Tsuruya, Numazu, all of Japan

[73] Assignee: Canon Kabushiki Kaisha, Tokyo, Japan

[21] Appl. No.: 847,495

[22] Filed: Apr. 25, 1997

[30] Foreign Application Priority Data

Apr. 26, 1996 [JP] Japan ..... 8-108169

[51] Int. Cl.[6] ..... G03G 15/01; G03G 15/16

[52] U.S. Cl. ..... 399/302; 399/308

[58] Field of Search ..... 399/302, 308, 399/66; 430/126

[56] References Cited

U.S. PATENT DOCUMENTS

| | | | |
|---|---|---|---|
| 4,095,886 | 6/1978 | Koeleman et al. | 399/308 |
| 4,931,839 | 6/1990 | Tompkins et al. | 399/66 |
| 5,600,423 | 2/1997 | Miyashiro et al. | 399/313 |

FOREIGN PATENT DOCUMENTS 2-50170 2/1990 Japan .

*Primary Examiner*—Joan H. Pendegrass
*Attorney, Agent, or Firm*—Fitzpatrick, Cella, Harper & Scinto

[57] ABSTRACT

An image forming apparatus for forming a toner image on a transfer material using an intermediary transfer member, includes a first image bearing member; toner image forming means for forming a toner image on said first image bearing member; an intermediary transfer member, as a second image bearing member, movable along an endless path in contact with said first image bearing member; first transfer means for transferring the toner image from said first image bearing member onto the intermediary transfer member at a first transfer position of said intermediary transfer member; second transfer means for transferring the toner image from said intermediary transfer member onto the transfer material at a second transfer position of said intermediary transfer member; wherein said intermediary transfer member comprises as a base material flexible rubber belt having a thickness of 0.5 to 3 mm, and an actual resistance $R_{B1}$ (Ohm) thereof and an electrostatic capacity $C_{B1}$ (F) satisfy:

$$R_{B1}<1/C_{B1}.$$

17 Claims, 4 Drawing Sheets

IMAGE FORMING APPARATUS EMPLOYING AN INTERMEDIARY TRANSFER MEMBER

FIELD OF THE INVENTION AND RELATED ART

The present invention relates to an image forming apparatus employing a system which transfers a visible image formed on a first image bearing member to a transfer material by way of a second image bearing member (intermediary transfer member).

An electrophotographic color image forming apparatus which comprises a second image bearing member (intermediary transfer member) in addition to a first image bearing member, such as a photosensitive drum, has been known in the past. In this type of image forming apparatus, the so-called primary transfer process, in which a toner image formed on the first image bearing member is temporarily transferred onto the second image bearing member, is repeated a predetermined number of times to superimpose a plurality of toner images onto the second image bearing member, and then, the plurality of toner images on the second image bearing member are transferred (secondary transfer process) onto a transfer material such as a sheet of paper all at once.

FIG. 4 shows a typical image forming apparatus which employs an intermediary transfer member.

The image forming apparatus illustrated in FIG. 4 has an electrophotographic photosensitive drum 101 as a first image bearing member. Around the photosensitive drum 101 supported so as to be rotatable in the direction of an arrow mark $R_1$, four developing devices 105, 106, 107 and 108 in which four color toners: black (Bk) toner, magenta (M) toner, cyan (C) toner, and yellow (Y) toner, are stored, correspondingly, are disposed in such a manner that the developing device which will be used to develop the current electrostatic image on the photosensitive drum 101 is placed in contact with the photosensitive drum 101 by an unillustrated developing device shifting means.

The photosensitive drum 101 is uniformly charged with a charger 102, and an electrostatic latent image is formed on the uniformly charged photosensitive member 101 by a scanning light beam (laser beam) projected from a laser based exposure optical system or the like. The electrostatic latent image is developed as a toner image by the aforementioned developing device 105 or the like; toner is adhered to the electrostatic latent image. The developed electrostatic latent image, that is, the toner image, is transferred (primary transfer) onto an intermediary transfer belt 109 (intermediary transfer member). When a color image is formed, the aforementioned process for forming an electrostatic latent image, and the process for developing an electrostatic latent image using one of the developing devices 105–108 or the like, are sequentially repeated for four colors to superimpose four color toner images on the intermediary transfer belt 109. Then, these toner images on the intermediary transfer belt 109 are transferred (secondary transfer) all at once onto a transfer material 118 as the transfer material 118 is conveyed, being pinched, by a secondary transfer roller 111 and the intermediary transfer belt 109.

Next, the aforementioned primary and secondary transfer processes will be described in more detail. When the photosensitive drum 101 is a negatively chargeable organic photoconductive member, negatively chargeable toner is used to develop the areas exposed by a laser beam 104, by the developing devices 105–108. Therefore, positive transfer bias is applied to the primary transfer roller 110 from a bias power source 120. As for the intermediary transfer belt 109, it is constituted of an endless film of resin material (electrical resistance is adjusted as needed) such as polyvinylidene fluoride, nylon, polyethylene terephthalate, polycarbonate or the like, and is normally 100–200 $\mu$m in thickness, $10^{11}$ Ω·cm–$10^{16}$ Ω·cm in resistance value. It is stretched around a roller 112 (opposing roller for the secondary transfer roller 111), a driving roller 115, a tension roller 116, and the like. As for the primary transfer roller 110, a roller with a low electrical resistance, which is no more than $10^5$ Ω·cm, is generally used. Usage of thin film as the intermediary transfer belt 109 makes it possible to give a large electrostatic capacity of several hundreds pF to several thousands pF to a primary transfer nip $N_1$, providing stable transfer current. In this case, the primary transfer roller 110 and the bias power source 120 constitute primary transferring means.

The secondary transfer process, that is, a process in which the toner image is transferred onto the transfer material 118, is carried out by secondary transferring means constituted of the secondary transfer roller 111, the roller 112 (hereinafter, opposing roller) which opposes the secondary transfer roller 111, the bias power source 121, and the like. The opposing roller 112, which is grounded or given a proper amount of bias, is disposed on the inwardly facing side of the intermediary transfer belt, and is used as an electrode which opposes the secondary transfer roller 111. The secondary transfer roller 111, which has a low electrical resistance, is disposed on the outwardly facing side of the intermediary transfer belt 112. Two rollers are kept pressured toward each other, with the intermediary transfer belt 109 being interposed between them, to form a secondary transfer nip $N_2$. In the secondary transfer process, positive transfer bias is applied from the bias power source 121 to the secondary transfer roller 111 which is in contact with the back side of the transfer material 118.

After the aforementioned primary transfer, the post-transfer residual toner (hereinafter, residual toner) on the surface of the photosensitive drum 101 after image transfer, is removed and recovered by a cleaner 119, and further, the post-transfer residual charge is removed by an exposing device 117, so that the photosensitive drum 101 can be used for the following image formation.

On the other hand, the intermediary transfer belt 109 is cleaned of the residual toner by a cleaner 113, and also is cleared of the charge by a discharging device 114. As for the discharging device 114, an AC type corona discharging device is widely used, wherein it is a common practice to place an electrode on the inward side of the intermediary transfer belt 109 in order to improve the charge removal efficiency.

As for the intermediary transfer member, an intermediary transfer roller is also usable in addition to the aforementioned intermediary transfer belt 109. However, the intermediary transfer belt 109 is more commonly used because the belt offers more latitude in placement than the roller, and also is superior to the roller in releasing the transfer material 118 after the secondary transfer (curvature release is possible).

In the case of the aforementioned conventional structure, the intermediary transfer belt 109, which has a relatively high electrical resistance, is employed, and therefore, there is no interference between the primary and secondary transfer biases, which makes the conventional structure advantageous in that the primary and secondary transferring means can be independently set up.

However, the relatively high electrical resistance of the intermediary transfer belt 109 brings forth the following problems:

(1) While the primary transfer process is repeated, the intermediary transfer belt 109 itself becomes charged, making it necessary for the value of the primary bias to be adjusted for each color by the amount proportional to the amount of the charge on the intermediary transfer belt 109.

(2) When the primary bias is excessively high, the excessive transfer bias and the large electrostatic capacity of the intermediary transfer belt 109 work together to cause electrical discharge (separation discharge) adjacent to the downstream end of the primary transfer nip $N_1$ between the photosensitive drum 101 and the intermediary transfer belt 109, that is, the point at which the photosensitive drum 101 and the intermediary transfer belt 109 separate from each other, and this separation discharge is liable to disturb the toner image on the intermediary transfer belt 109. In other words, it is rather difficult to adjust the primary bias to the optimum level.

(3) Means for removing the aforementioned residual charge from the intermediary transfer belt 109 after the secondary transfer is necessary, which complicates the structure and also makes it difficult to reduce cost.

As for means for solving these three problems, it is possible to reduce the electrical resistance of the intermediary transfer belt 109 by dispersing electrically conductive material in the intermediary transfer belt 109, but such a means creates the following problems, which are different from the aforementioned problems:

(1) If the electrical resistance value of the intermediary transfer belt 109 is excessively reduced, current flows between the primary transfer point and the secondary transfer point, that is, interference occurs between the transfer current at the primary transfer point and the transfer current at the secondary transfer point, and therefore, it becomes impossible to carry out the primary and secondary transfer processes at the same time; in other words, the intermediary transfer belt 109 must be idled one rotation between the primary and secondary transfer processes, which reduces throughput.

(2) If the electrical resistance value of the intermediary transfer belt 109 is reduced to an extremely low level, extremely large current is liable to flow between the secondary transfer roller 111 and the opposing roller 112 (electrode placed on the opposite side of the intermediary transfer belt 109), through the intermediary transfer belt 109, outside the path of the transfer material 118.

As for means for preventing the above problems (1) and (2), there are the following:

A. Theoretically, it is possible to control the bias power source 121 so that current remains constant. However, this is practically impossible in consideration of the large variety of transfer materials and their widths.

B. According to the proposal disclosed in Japanese Laid-Open Patent Application No. 50,170/1990, for example, a grounded electrode (unillustrated) is placed in contact with the inwardly facing surface of the intermediary transfer belt 109, on the upstream side of the secondary transfer nip $N_2$, and the opposing roller 112 is allowed to float, or is given a high electrical resistance, so that the secondary transfer current is caused to flow into this grounded electrode to stabilize the current. However, this proposal complicates the structure. In addition, both the surface resistance and volumetric resistance of the intermediary transfer belt 109 affect the secondary transfer current, and therefore, it is difficult to choose them properly. Further, the position and contact pressure of the electrode are also the factors which affect the secondary transfer current value. Therefore, it is not easy to stabilize the transfer process with the use of this grounded electrode.

SUMMARY OF THE INVENTION

The primary object of the present invention is to improve the toner transfer efficiency in each of the transferring portions.

Another object of the present invention is to prevent a toner image from being disturbed during a primary transfer process, that is, while the toner image is transferred from a photosensitive drum onto an intermediary transfer member.

Another object of the present invention is to prevent a toner image from being disturbed during a secondary transfer process, that is, while the toner image is transferred from an intermediary transfer member onto a transfer material.

Another object of the present invention is to make it possible to keep desirable the state of the charge of the toner transferred onto an intermediary transfer member, without the provision of dedicated means therefor.

According to an aspect of the present invention, an image forming apparatus, which forms a toner image on a transfer material using an intermediary transfer member, comprises a first image bearing member, a toner image forming means for forming a toner image on the first image forming apparatus, an intermediary transfer member as a second image bearing member which endlessly moves in contact with the first image bearing member to be used for transferring a toner image onto a transfer material, a first transferring member for transferring (primary transfer) a toner image formed on the first image bearing member, onto the intermediary transfer member at the first transfer point for the intermediary transfer member, and a second transfer means for transferring (second transfer) a toner image having been transferred onto the intermediary transfer member, onto a transfer material at the second transfer point for the intermediary transfer member, wherein the intermediary transfer member is constituted of a 0.5–3.0 mm thick endless flexible belt of rubber material, and satisfies the following formula:

$$R_{B1}<1<C_{B1}$$

$R_{B1}$ (Ω): actual electrostatic resistance value of the intermediary transfer member at the first transfer point $C_{B1}$ (F): electrostatic capacity of the intermediary transfer member at the first transfer point These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Hereinafter, the embodiments of the present invention will be described with reference to the drawings Embodiment 1

Figure 1:
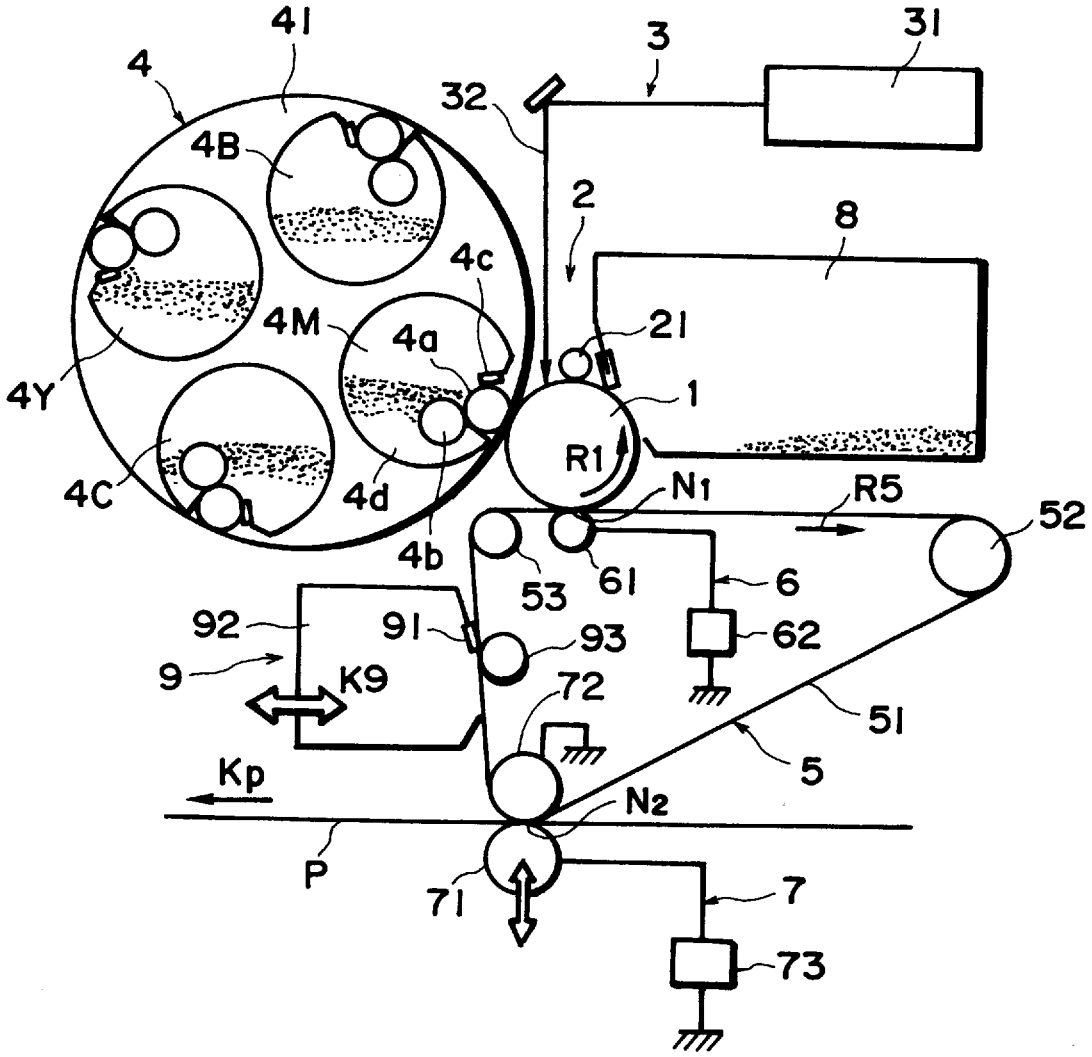
FIG. 1 is a schematic section of the image forming apparatus in the first embodiment of the present invention, and depicts the general structure thereof.

FIG. 1 is a schematic section of the image forming apparatus in the first embodiment of the present invention, and depicts the general structure thereof. First, the general structure and operation of the image forming apparatus will be described with reference to FIG. 1.

The image forming apparatus illustrated in the drawing is a full color image forming apparatus based on four colors. It comprises seven major structural members (means): a first image bearing member 1, visual image forming means 2, 3 and 4, a first image bearing member 5, a first transferring member 6, and a second transferring member 7. As for an image forming general operation involving these major structural members, a visible image is formed on the first image bearing member 1 by the visible image forming means 2, 3 and 4. Then, the visible image is temporarily transferred (primary transfer) onto the second image bearing member 5 by the first transferring member 6. Thereafter, the visible image currently on the second image bearing member 5 is transferred onto a transfer material P such as a sheet of paper by the second transferring means 7. These operational steps will be described in detail following the above order.

The first image bearing member 1 illustrated in the drawing is an electrophotographic photosensitive member (hereinafter, "photosensitive drum") in the form of a drum. The photosensitive drum 1 comprises a cylindrical base member of aluminum, and a photosensitive layer of, for example, organic photoconductor which covers the peripheral surface of the base member, and is rotatively driven in the direction of an arrow mark R1 by a driving means (unillustrated).

The visible image forming means comprises a charging means 2, an exposing means 3, a developing means 4, and the like. The charging means 2 is constituted of a charging roller 21 disposed in contact with the photosensitive drum 1, and an electrical power source (unillustrated) for applying a charge bias to the charge roller 21. In this embodiment, the surface of the photosensitive drum 1 is uniformly charged to the negative polarity by this power source through the charge roller 21.

The exposing means comprises a laser based optical system 31, and exposes the surface of the photosensitive drum 1 to a scanning laser beam 32, which reflects the image data of a target image, so that the charges on the exposed areas are removed to form an electrostatic latent image on the surface of the photosensitive drum 1.

The developing member 4 comprises a rotary member 41, and four developing devices 4M, 4C, 4Y and 4B which are mounted on the rotary member 41 and contain magenta, cyan, yellow and black developers (toners), correspondingly. These developing devices are moved by the rotary member 41 so that the one which is to be used for developing the electrostatic latent image, which is currently on the photosensitive drum 1, is moved to a developing point at which this particular developing device is caused to face the surface of the photosensitive drum 1. The four developing devices have the same structure. To describe their structures with reference to the structure of the magenta developing device 4M, it comprises a rotary developing sleeve 4*a*, a roller 4*b* for coating toner on the surface of the developing sleeve 4*a*, an elastic blade 5*c* for regulating the thickness of the toner layer coated on the surface of the developing sleeve 4*a*, and the like member.

As for the developing operation, negatively chargeable, single component nonmagnetic toner in a toner storing container 4*d* is uniformly coated, the toner particles becoming charged, on the peripheral surface of the developing sleeve 4*a*. To the photosensitive drum 1, a development bias which puts the developing sleeve 4*a* on the negative side relative to the photosensitive drum 1 is applied, whereby the magenta toner is adhered to the electrostatic latent image on the photosensitive drum 1; a reversal developing process is carried out to develop a magenta toner image.

The second image bearing member is constituted of an intermediary transfer belt 51 (intermediary transfer member). The intermediary transfer belt 51 is a 0.5–3.0 mm thick endless flexible belt, and is stretched around a driver roller 52, a follower roller 53, an opposing roller 72, which will be described later, and the like, and is rotatively driven in the direction of an arrow mark R5. The intermediary transfer belt 51 is pinched by the photosensitive drum 1, which is disposed on the outward side of the intermediary transfer belt 51, and a primary transfer roller 51, which is disposed on the inward side of the intermediary transfer belt 51, and will be described later; the outwardly facing surface of the intermediary transfer belt 51 and the peripheral surface of the photosensitive member 1 are placed in contact with each other, forming a first transfer nip $N_1$ (first transfer point), which extends in the direction of the generatrix of the peripheral surface of the photosensitive drum 1.

The first transferring means 6 comprises a primary transfer roller 61, which is disposed so as to make contact with the inwardly facing surface of the intermediary transfer belt 51 at a point where it opposes the photosensitive drum 1, and an electrical power source 62 for applying the primary transfer bias to the primary transfer roller 61. The magenta toner image formed on the photosensitive drum 1 is transferred (primary transfer) onto the intermediary transfer belt 51 by applying the primary transfer bias to the primary transfer roller 61 from the electrical power source 62. After the primary transfer process, the toner which remained on the surface of the photosensitive drum 1 is cleaned (removed) by a cleaner 8, to ready the photosensitive drum 1 for the following image forming process, that is, the image forming process for a cyan image.

The image forming sequence comprising the above described charging, exposing, developing, transferring (primary), and cleaning processes is carried out also for the other colors, that is, cyan, yellow, and black, to superpose four color toner images on the intermediary transfer belt 51.

The second transferring means 7 comprises a second transfer roller 71 disposed on the outwardly facing side of the intermediary transfer belt 51, and a roller 72 (hereinafter, opposing roller 72) which opposes the secondary transfer roller 71. The intermediary transfer belt 51 is pinched between these two rollers 71 and 72, so that a second transfer nip $N_2$ (second transfer point) is formed between the peripheral surface of the secondary transfer roller 71 and the intermediary transfer belt 51; the second transfer nip $N_2$ extends in the longitudinal direction of the secondary transfer roller 71. To the second transfer roller 71, an electrical power source 72, to which the bias for the secondary transfer is applied, is connected, whereas the opposing roller 72 is grounded. The four color toner images having been transferred (primary transfer) onto the intermediary transfer belt 51 are transferred (secondary transfer) all at once onto the transfer material P such as a sheet of paper by applying the secondary transfer bias to the secondary transfer roller 71 from the electrical power source 73.

After the second transfer process, the toner which remained on the surface of the intermediary transfer belt 51 is removed by a cleaner 9. The cleaner 9 comprises a main structure which has a cleaning blade 91 and is movable in the direction of an arrow mark K9, and a helper roller 93 disposed in a manner to oppose the cleaning blade 91, with the to intermediary transfer belt 51 being interposed between the two members. The toner which remained on the surface of the intermediary transfer belt 51 after the secondary transfer process is removed (recovered) by moving the cleaner main structure in the direction of the arrow mark K9 so that the intermediary transfer belt 51 is pinched by the cleaning blade 91 and the helper roller 93.

On the other hand, the transfer material P onto which the four color toner images have been transferred is heated and pressed by a fixing apparatus (unillustrated) to fix the toner images to the surface of the transfer material P, and then, is discharged out of the main assembly of the image forming apparatus.

During the aforementioned image forming process, the process speed $V_p$ is set at 10.0 cm/sec, and the transfer material P is conveyed in the direction of an arrow mark $K_p$ by a transfer material conveying means (unillustrated).

Next, the second image bearing member 5, the first transferring means 6, and the second transferring means 7, which characterize the present invention, will be described in more detail.

The material of the intermediary transfer belt 51 is nitrile rubber having a hardness of approximately 60 degrees in JIS-A scale, and an electrical resistance value of approximately $5\times10^8$ Ω·cm which is attained by the addition of carbon, titanium oxide, tin oxide, or the like to the rubber material. This rubber material is extrusion-molded into a seamless endless belt 51 which is 1 mm in thickness, 220 mm in width, and approximately 140πmm in peripheral length. Compared to the thickness of a typical conventional belt (mainly, resin belt), which is generally in a range of 50–200 μm the thickness of the belt in this embodiment, which is 1 mm, is an extremely large, but using a belt having such a thickness as that of the intermediary belt 51 in this embodiment provides the following advantages:

(1) The electrostatic capacity of the intermediary transfer belt 51 itself can be minimized, and therefore, the exchanging of the charge between the photosensitive drum 1 and the primary transfer roller 61, and between the secondary transfer roller 71 and the opposing roller 72, is affected only by the electrical resistance value of the intermediary transfer belt 51; it is barely affected by the electrostatic capacity of the intermediary transfer belt 51. Therefore, current leakage (excessive transfer current) which is liable to be caused by rush current can be prevented. Further, the strength of the electric field within the loop of the intermediary transfer belt 51 can be reduced; therefore, voltage resistance is improved, preventing the occurrence of dielectric breakdown.

(2) Since rubber material such as nitrile rubber is used as the material for the intermediary transfer belt 51, the friction coefficient of the intermediary transfer belt 51 is high enough for the intermediary transfer belt 51 to be moved at a steady speed by the application of a tension as low as several kilograms.

(3) The mechanical strength of the intermediary transfer belt improves.

(4) The transfer material P is less liable to be electrostatically adhered to the intermediary transfer belt 51 during the secondary transfer process. Therefore, it does not occur that the transfer material P fails to separate from the intermediary transfer belt 51, or that the toner images are disturbed when the transfer material P is separated from the intermediary transfer material P.

Next, (1) and (4) among the above four advantages, will be described in more detail.

Referring to FIG. 1, more thought will be given to a current $i_T$ which flows through the nip portions, for example, the first transfer nip $N_1$ and the second transfer nip $N_2$, between various members (photosensitive drum 1, second transfer roller 2, and the like) and the intermediary transfer belt 51.

Figure 2:
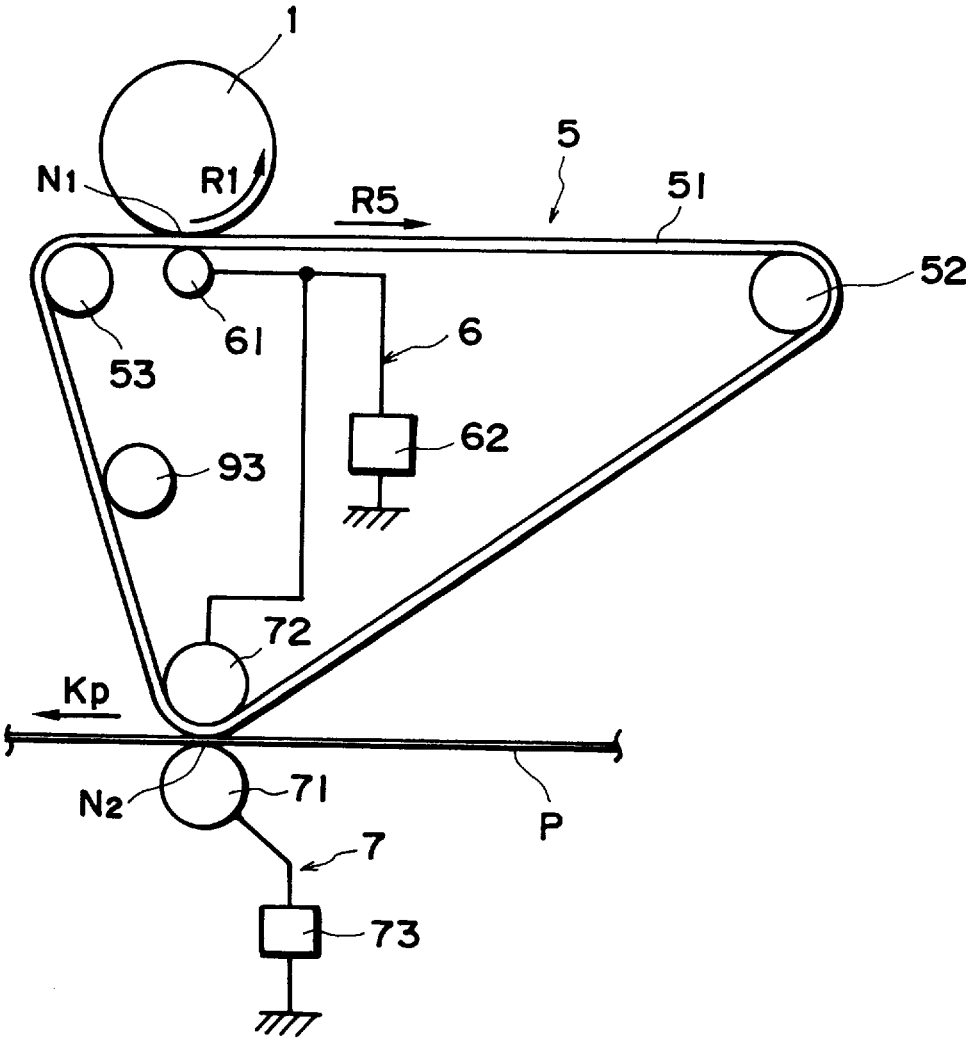
FIG. 2 is an enlarged section of the intermediary transfer belt and the adjacencies thereof in the third embodiment of the present invention, and depicts the structure thereof.

Referring to FIG. 2, $i_T=i_R+i_C$

In this case, a capacitance $C_B$ (capacitances $C_{B1}$ and $C_{B2}$ correspond to the primary and secondary transfer nips $N_1$ and $N_2$, respectively) which contributes per unit time is obtained by the following formula:

$$C_B=\Sigma_S\cdot\Sigma_O\times(V_p\cdot L/t_B)(F) \quad (1)$$

$V_p$ (m/sec): speed of the intermediary transfer belt

L (m): length of the contact in the axial direction (direction perpendicular to the rotational direction of the intermediary transfer belt 51)

$\Sigma_S$: dielectric constant $t_B$ (m): thickness $\Sigma_O=8.854188\times10^{12}\mathrm{F\cdot m^{-1}}$ Therefore, a current $i_C$ which electrostatically flows through the nip portion of the intermediary transfer belt 51 is obtained by the following formula:

$$i_C=C_B\cdot V_T(A) \quad (2)$$

$V_T$ (V): voltage applied to the intermediary transfer belt

On the other hand, a current $i_R$ which flows through the resistive component in the nip portion is obtained by the following formula:

$$i_R=V_T/R_B(A) \quad (3)$$

$R_B$ (Ω): actual resistance value of the intermediary transfer member in the nip portion It should be noted here that the actual resistance values $R_B$ corresponding to the first and second transfer nips $N_1$ and $N_2$ are designated by $R_{B1}$ and $R_{B2}$, respectively.

The transfer current $i_T$ necessary for the primary or secondary transfer is several microamperes to several tens of microamperes.

As for the type of the intermediary transfer belt 51, if $i_C>i_R$, the intermediary transfer belt 51 can be said to be of a type in which the transfer current is affected mainly by the capacitance, and on the contrary, if $i_C<i_R$, it can be said to be of a type in which the transfer current is affected mainly by the resistive component. In the past, the former type in which the capacitance plays the main role has been employed. On the contrary, the present invention is characterized by the aforementioned items (1) and (4), that is, of the latter type in which the resistive component plays the main role. Therefore, the upper limit of the resistance value $R_B$ of the intermediary transfer belt 51 is obtained by the following formula which is derived from an inequality: $i_C<i_R$, the formula (2), and the formula (3):

$$R_B<1<C_B \quad (4)$$

Further, from the formula (1)

$$R_B<t_B<(\Sigma_S \cdot \Sigma_O \cdot V_P \cdot L) \quad (5)$$

In other words, the smaller the thickness $t_B$ of the intermediary transfer belt 51 is, or the larger the dielectric constant $\Sigma_S$ is, the more the resistance value $R_B$ of the intermediary transfer belt 51 must be reduced, otherwise the intermediary transfer belt 51 does not become the type in which the resistive component plays the main role.

In comparison, a typical conventional intermediary transfer belt made of resin material has a thickness $t_B$ of 100 $\mu$m and a dielectric constant of 3–9, and therefore, unless the actual resistance value $R_B$ of the intermediary transfer belt 51 is no more than approximately $10^8$ Ω, the formula (5) cannot be satisfied. On the other hand, if the resistance value is reduced, the hardness of the intermediary transfer belt 51 increases due to the characteristics of the resin material (obviously, the thickness $t_B$ may be increased, but in the case of the resin material, when the thickness of the material is no less than 200 $\mu$m, it becomes too rigid to provide the belt with sufficient flexibility). Therefore, the aforementioned type in which the transfer current is controlled mainly by the capacitance is suitable.

On the contrary, in the case of the present invention, the dielectric constant $\Sigma_S$ itself is within a range of 2–7. However, even when the thickness $t_B$ is increased, a proper amount of flexibility can be assured, resultantly affording reduction in capacitance. Therefore, attention was paid to the characteristics of rubber material whose resistance can be easily reduced while maintaining flexibility, and the intermediary transfer belt 51 was formed to satisfy the aforementioned formula (5).

More specifically, as for the rubber material suitable for the present invention, those having a hardness in a range of 50–80 degrees in JIS-A scale, and a thickness in a range of 0.5–3.0 mm, preferably, 0.7–1.5 mm, are desirable in terms of strength, flexibility, capacitance, and the like.

Next, the resistance value of the primary transferring means 6 will be described in relation to the primary transfer nip $N_1$. The primary transferring means 6 comprises a primary transfer roller 61 which is disposed to place the intermediary transfer belt 51 flatly in contact with the photosensitive drum 1 having a diameter of approximately 47 mm. In other words, the intermediary transfer belt 51 is pinched by the peripheral surfaces of the photosensitive drum 1 and the primary transfer roller 61. With this arrangement, the rectangular primary transfer nip $N_1$ having a width of 5 mm (in the rotational direction of the intermediary transfer belt 51) is formed between the surfaces of the photosensitive drum 1 and the intermediary transfer belt 51.

As the primary transfer roller 61, an EPDM rubber roller having a diameter of 8 mm and a volumetric resistance value of no more than $104^4$ Ω·cm is employed. The primary transfer nip $N_1$ is formed by placing the primary transfer roller 61 so that the primary transfer roller 61 presses on the photosensitive drum 1 with an overall pressure of approximately 400 g, with the intermediary transfer belt 51 being pinched between the photosensitive drum 1 and the primary transfer roller 61. The combined resistance value $R_1$ of the primary transfer roller 61 and the intermediary transfer belt 51 in the primary transfer nip $N_1$ was approximately $1\times10^8$ Ω (actually, it was measured using a metallic drum having the same diameter as the photosensitive drum 1). With the above described arrangement, the toner images could be fairly satisfactorily transferred by setting the primary transfer bias voltage value $V_{T1}$ at +250 V for the first color, +250 V for the second color, +310 V for the third color, and +340 V for the fourth color. The reason why the transfer bias voltage had to be gradually shifted between the first color and the fourth color to obtain the optimum results is not because the intermediary transfer belt 51 itself was charged up, but mainly because the toner was gradually built up on the intermediary transfer belt 51. As a matter of fact, the charging up of the intermediary transfer belt 51 could not be observed at all.

In terms of the primary transfer performance, when the aforementioned combined resistance value $R_1$ of the intermediary transfer belt 51 and the primary transfer roller 61 is excessively large, transfer failure occurs due to the lack of the transfer current, whereas when it is excessively small, the toner which remains after the transfer of the first color toner image causes transfer failure for the second color and thereafter, and further, when it is extremely small, image disturbance is liable to occur due to the current leakage through the pin holes of the photosensitive drum 1, and/or the concentration of the electric field to the adjacencies of the toner particles during the primary transfer process. More specifically, the transfer failure traceable to the former cause, that is, the lack of the transfer current, occurs when the combined resistance value $R_1$ is no less than approximately $5\times10^9$ Ω, and the transfer failure traceable to the latter cause, that is, the transfer failure involving the second color and thereafter occurs when the combined resistance value $R_1$ is no more than $5\times10^7$ Ω, and it becomes worse when the combined resistance value $R_1$ is no more than $1\times10^7$ Ω. The pin hole leakage or the like occurs when the combined resistance value $R_1$ is no more than $10^4$ Ω.

When the combined resistance value $R_1$ is no less than approximately $2\times10^9$ Ω, the primary transfer voltage necessary for flowing the primary transfer current (several microamperes to several tens of microamperes) becomes too large, and causes aerial discharge between the photosensitive drum 1 and the intermediary transfer belt 51. This aerial discharge causes a problem in that it charges the toner to the reverse polarity, and therefore, N-th (N=1) color toner is transferred back to the photosensitive drum 1 during the process in which the N-th (N=2, 3 and 4) color toner image is transferred. Therefore, this value of $2\times10^9$ Ω is the upper limit for the combined resistance value $R_1$. Further, since the actual resistance value $R_{T1}$ of the primary transfer roller 61 is sufficiently small, the combined resistance value $R_1$ is approximately equal to the actual resistance value $R_{B1}$ of the intermediary transfer belt 51 in the primary transfer nip $N_1$.

Next, the secondary transferring means 7 and its resistance value in the secondary transfer nip $N_2$ will be described. The secondary transferring means 7 comprises an EPDM rubber roller 71 having a diameter of 16 mm, a hardness of 25° in ASKA-C scale, and an electrical resistance in the medium range. This secondary transfer roller 71 is disposed so that it is pressed against the metallic opposing roller 72 having a diameter of 22 mm, with the intermediary transfer belt 51 being pinched between the two rollers 71 and 72, with an overall pressure of 500 g. In this embodiment, the opposing roller 72 is grounded. With the above setup, the secondary transfer nip $N_2$ having a width of approximately 3 mm is formed as the secondary transfer portion. The resistance value $R_2$ between the secondary transfer roller 71 and the opposing roller 72 measured with the intermediary transfer belt 5 being pinched between the two rollers was approximately $1\times10^9$ Ω. In consideration of the fact that the serial resistance of the intermediary transfer belt 51 is sufficiently small, the resistance value $R_2$ can be said to be substantially equal to the resistance value $R_2$ of the secondary transfer roller 71.

With the above described structure in place, the voltage value $V_{T2}$ of the secondary transfer bias applied to the secondary transfer roller 71 was measured. The results reveal that more or less satisfactory secondary transfer performance was obtained with the application of approximately +3 kV.

According to a study made of the proper range for the aforementioned combined resistance value $R_2$ of the intermediary transfer belt 51, secondary transfer roller 71, and opposing roller 72 in terms of the second transfer performance, the upper limit becomes approximately $5\times10^9$ Ω, which is the same as the threshold value in terms of the primary transfer failure. However, during the secondary transfer process, the toner images are transferred all at once, making it unnecessary for the threshold value in terms of the backward transferring of the toner images to be taken into consideration (approximately $2\times10^7$ Ω in the case of the primary transfer). Therefore, the upper limit of the actual resistance value $R_{T2}$ of the secondary transfer roller 71 alone is $5\times10^9$ Ω.

As for the lower end threshold resistance value, since the lower end threshold value of the intermediary transfer belt 51 is approximately $10^7$ Ω, the combined resistance value $R_2$ inclusive of the resistance value of the secondary transfer roller 71 is greater than this value. As for the resistance value of the secondary transfer roller 71 itself, as long as it is no less than $10^4$ Ω, it is unnecessary to be concerned with the leak. Further, if the resistance value involving the intermediary transfer 51 and the secondary transfer roller 71 in the secondary transfer nip $N_2$ is regulated in the following manner, a new benefit will be provided. Next, this new benefit will be described.

Generally, the peripheral length of the intermediary transfer belt 51 is extremely long in comparison with those of the secondary transfer roller 71 and the opposing roller 71. Therefore, the electrical resistance of the intermediary transfer belt 51 may be substantially different depending on the area on the belt (in the order of single digit). If the secondary transfer voltage $V_{T2}$ is placed under constant voltage control when the resistance of the intermediary transfer belt 51 is substantially different depending on the area of the belt, the secondary transfer current greatly changes, which results in nonuniform toner image transfer. On the other hand, if the secondary transfer current $i_{T2}$ is placed under constant current control, the nonuniform toner image transfer in the rotational direction of the intermediary transfer belt 51 is reduced, but the nonuniformity in the axial direction remains unaffected. Therefore, in order to stabilize the combined resistance value $R_2$ to prevent the nonuniform transfer of the toner images inclusive of the nonuniformity in the axial direction, it is effective to reduce the share that the actual resistance value of the intermediary transfer belt 51 contributes to the combined resistance value $R_2$, and increase the other resistance values by the amount equivalent to the reduced resistance value of the intermediary transfer belt 51.

In other words, the actual resistance value $R_{T2}$ of the second transfer roller 71 ought to be rendered larger than the actual resistance value $R_{B2}$ of the intermediary transfer belt 51. In comparison, if the actual resistance value $R_{A2}$ of the opposing roller 72 is increased instead of the actual resistance value $R_{T2}$ of the second transfer roller 71, the secondary transfer current flows into the primary transfer roller 61; interference occurs between the primary and secondary transfer points. In addition, if a transfer material P with a small size is passed through the apparatus under the condition that the resistance of the secondary transfer roller 71 is rendered low and the resistance of the opposing roller 72 is rendered high, the transfer current concentrates between the second transfer roller 71 and the intermediary transfer belt 51, outside the transfer sheet path, creating a problem such as damage to the intermediary transfer belt 51.

Due to the reasons listed above, the actual resistance value $R_{T2}$ of the secondary transfer roller 71, the actual resistance value $R_{B2}$ of the intermediary transfer belt 51, and the actual resistance value $R_{A2}$ of the opposing roller 72 are set to satisfy the following formula:

$$R_{T2}>R_{B2}>R_{A2} \tag{6}$$

More specifically, a phenomenon that the nonuniform resistance of the intermediary transfer belt 51 manifests as disturbance in the transferred image can be greatly reduced by setting the actual resistance value $R_{T2}$ at a level approximately twice the actual resistance value $R_{B2}$ or higher. Further, the larger the value of $R_{T2}/R_{B2}$ is, the less the transferred image is affected by the nonuniformity of the actual resistance value $R_{B2}$, but from the standpoint of practicality, it should be set within a range of twice to 100 times. As is obvious from the description given as to the primary transfer process, the actual resistance value $R_B$ of the intermediary transfer belt 51 needs to be set in a range of $10^7$ Ω–$5\times10^9$ Ω, preferably, $5\times10^7$ Ω to $2\times10^9$ Ω (provided that the width of the primary transfer nip $N_1$ is made to be 5 mm), and therefore, the resistance value $R_{T2}$ of the secondary transfer roller 71 needs to be set so that the combined resistance value $R_2$ of the secondary transfer roller 71 and the intermediary transfer belt 51 remains below $5\times10^9$ Ω.

Embodiment 2

In the first embodiment described above, the intermediary transfer belt 51 is described as a belt formed of NBR rubber alone. However, a releasing layer having a thickness of several microns to several tens of microns may be provided on the surface of the NBR rubber belt in consideration of the ease of cleaning of the intermediary transfer belt 51 by the cleaner 9. As for the material for the releasing layer, urethane binder in which fluorinated resin has been dispersed, or the like material may be used. Even in the case of such an intermediary transfer belt, as long as the electrical characteristics of the intermediary transfer belt 51 inclusive of the releasing layer, and the characteristics of the secondary transfer roller 71 are rendered so that the conditions which had to be satisfied in the first embodiment can be satisfied, the same effects as those described in the first embodiment can be obtained.

As for the rubber material for the base layer of the intermediary transfer belt 51, polychloroprene rubber, EPDM rubber, the mixture of the preceding two materials, urethane rubber, or various other rubber materials, can be used in addition to NBR rubber.

In particular, the material composed by mixing EPDM rubber into NBR rubber is desirable since it improves the intermediary transfer belt 51 in ozone resistance.

Embodiment 3

FIG. 2 depicts the third embodiment of the present invention.

In the drawing, the intermediary transfer belt 51, primary transfer roller 61, and secondary transfer roller 71, and the like, are the same as those described in the first and second embodiments, whereas in this embodiment, a bias voltage equal to the bias voltage applied to the primary transfer roller 61 is applied to the opposing roller 72 to equalize the electrical potential of both rollers so that the primary and secondary transfer biases are prevented from interfering with each other through the intermediary transfer belt 51.

In this case, it is necessary that the resistance values of both the primary transfer roller 61 and the opposing roller 72 are sufficiently smaller than the resistance value $R_B$ of the intermediary transfer belt 51 and the resistance value $R_{T2}$ of the secondary transfer roller 71. With the implementation of this structure, even if an electrical power source 73 for applying the bias for the secondary transfer is turned on or off while the primary transfer process is carried out, the current for the secondary transfer flows into only the opposing roller 72; the secondary and primary transfer currents can be prevented from flowing into the primary transfer roller 61 and the opposing roller 72, respectively, through the intermediary transfer belt 51. Therefore, the electrical potential of the intermediary transfer belt 51 is not disturbed in the primary transfer nip $N_1$.

In other words, no trouble occurs even when the primary transfer process is started for the following transfer material P while the secondary transfer process is carried out for the preceding transfer material P. Further, if the output of the electric power source 62 for the primary transfer bias application is applied to the ground side of the electric power source 72 for the second transfer bias application in a superimposing manner, it is possible to prevent the second transfer process from being affected by the turning on or off of the primary transfer bias.

Embodiment 4

Figure 3:
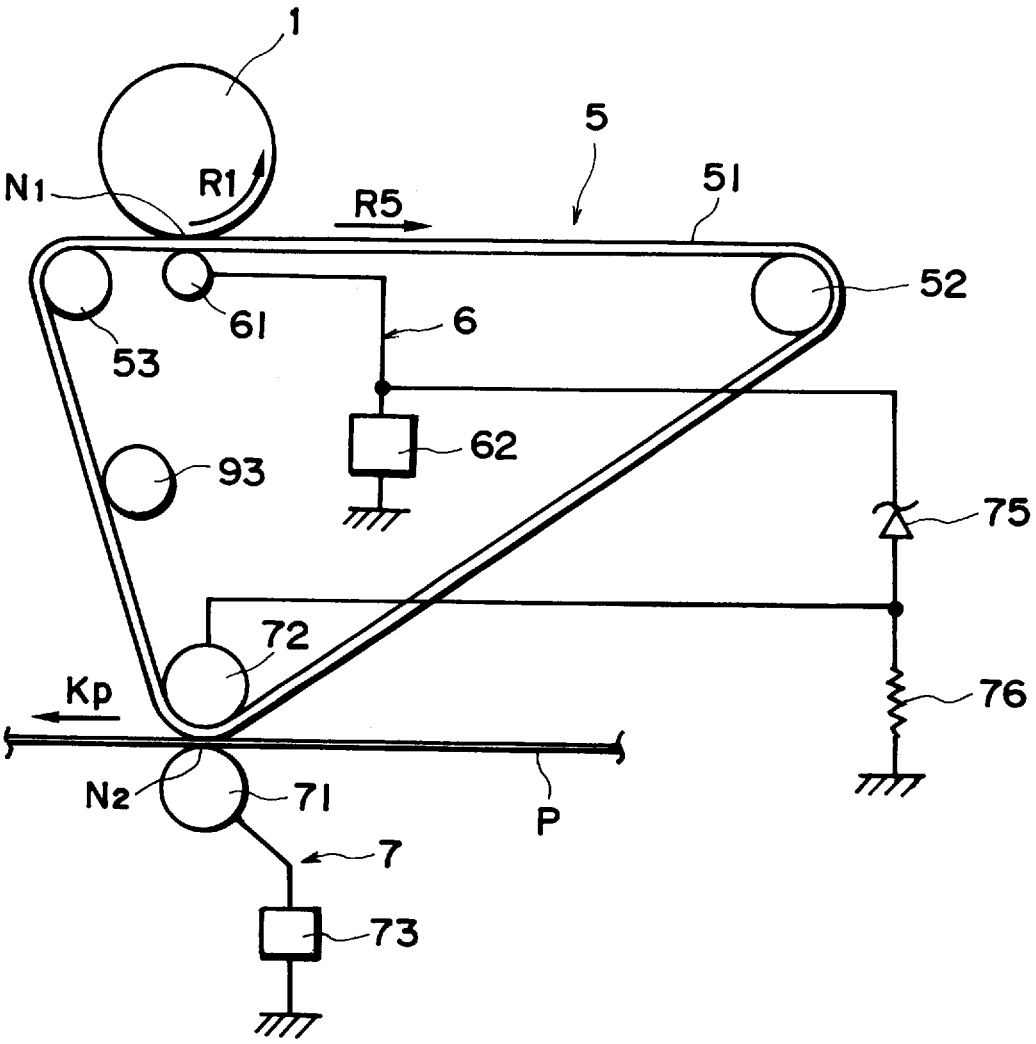
FIG. 3 is an enlarged section of the intermediary transfer belt and the adjacencies thereof in the fourth embodiment of the present invention, and depicts the structure thereof.
Figure 4:
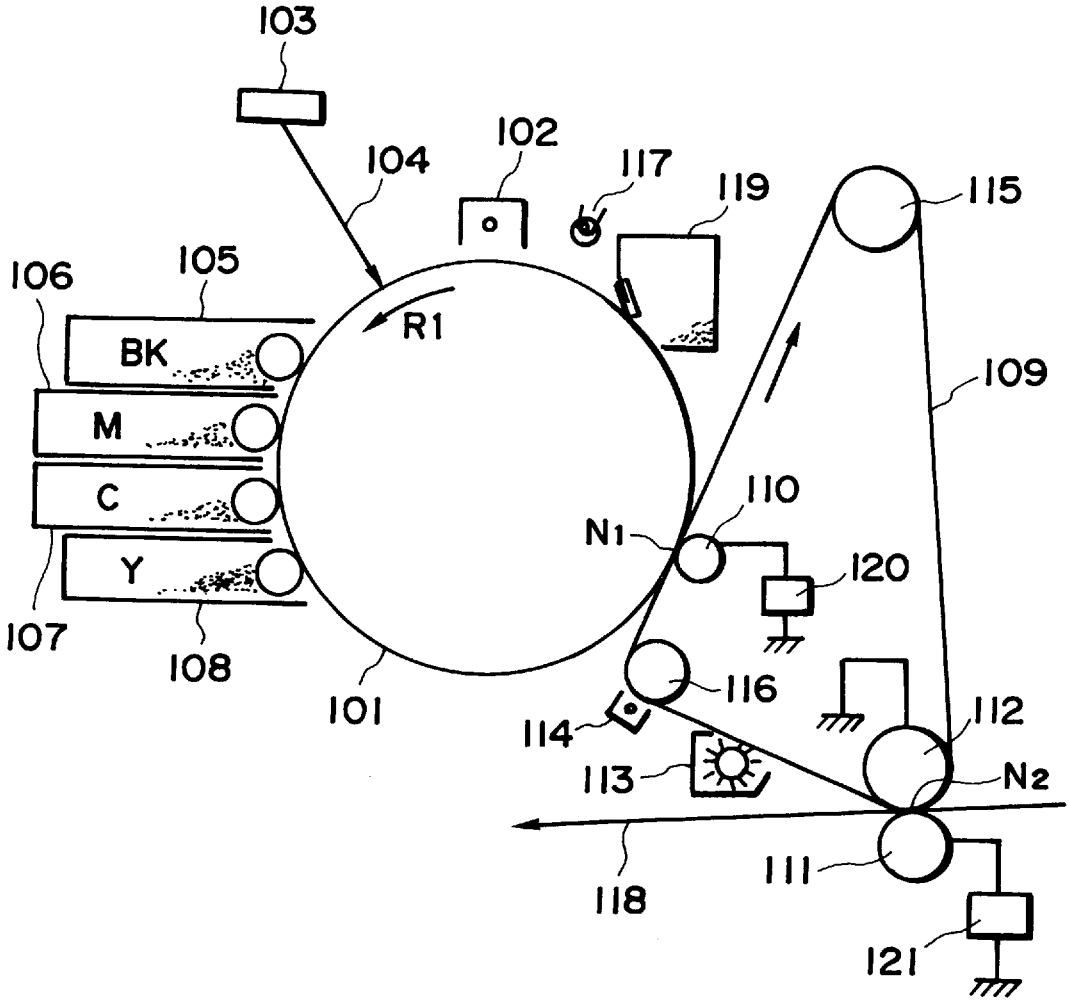
FIG. 4 is a schematic section of a conventional image forming apparatus, and depicts the general structure thereof.

FIG. 3 depicts the fourth embodiment of the present invention. This fourth embodiment is a result of the further development of the third embodiment. That is, in this embodiment, a bias having the same polarity as the primary transfer bias, but a smaller value than the primary transfer bias, is applied to the opposing roller 72. In this case, the value of the bias applied to the opposing roller 72 is determined by the partial pressure of a constant voltage element 75 and a resistor 76. With this setup, the interference between the secondary and primary transfer biases can be prevented to a certain degree, and therefore, the secondary transfer current can be stabilized by the same degree. This fourth embodiment falls somewhere between the first and third embodiments; its similarity to the first and third embodiments can be rendered closer to the first or third embodiment depending an the size of the constant voltage element 75.

As described above, according to the present invention, the second image bearing member is constituted of a 0.5–3.0 mm thick flexible belt of rubber material, and its actual resistance value $R_{B1}$ and capacitance $C_{B1}$ at the primary transfer position are set up to satisfy the inequality: $R_{B1}<1<C_{B1}$. Therefore, the secondary image bearing member in accordance with the present invention is superior in mechanical strength, and less liable to be affected by the capacitance $C_B$. As a result, the secondary image bearing member displays more desirable image transfer performance, rotates more smoothly, and is more durable than the conventional secondary image bearing member. Further, the secondary image bearing member conveys a transfer material in a more desirable manner since a transfer material is less liable to be adhered to the secondary image bearing member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus for forming a toner image on a transfer material using an intermediary transfer member, comprising:

a first image bearing member;

toner image forming means for forming a toner image on said first image bearing member;

an intermediary transfer member, as a second image bearing member, movable along an endless path in contact with said first image bearing member;

first transfer means for transferring the toner image from said first image bearing member onto the intermediary transfer member at a first transfer position of said intermediary transfer member;

second transfer means for transferring the toner image from said intermediary transfer member onto the transfer material at a second transfer position of said intermediary transfer member;

wherein said intermediary transfer member comprises as a base material flexible rubber belt having a thickness of 0.5 to 3 mm, and an actual resistance $R_{B1}$ (Ohm) thereof and an electrostatic capacity $C_{B1}$ (F) satisfy:

$$R_{B1}<1/C_{B1}.$$

2. An apparatus according to claim 1, wherein the actual resistance satisfies:

$$1\times10^7\leqq R_{B1}\leqq2\times10^9.$$

3. An apparatus according to claim 1, wherein said second transfer means comprises a secondary transfer roller and a secondary opposite roller which cooperate to nip said intermediary transfer member, and an actual resistance $R_{T2}$ (Ohm) of said secondary transfer roller satisfies:

$$1\times10^4\leqq R_{T2}\leqq5\times10^9$$

when the transfer material is nipped between said intermediary transfer member and said secondary opposite roller.

4. An apparatus according to claim 1, wherein said second transfer means comprises a secondary transfer roller and a secondary opposite roller which cooperate to nip said intermediary transfer member, and an actual resistance $R_{T2}$ (Ohm) of said secondary transfer roller, an actual resistance $R_{B2}$ (Ohm) of said intermediary transfer member and an actual resistance of said secondary opposite roller $R_{A2}$ (Ohm) satisfy:

$$R_{T2}>R_{B2}>R_{A2}.$$

5. An apparatus according to claim 4, wherein the actual resistance $R_{T2}$ (Ohm) of said secondary transfer roller and the actual resistance $R_{B2}$ (Ohm) of the intermediary transfer member satisfy:

$$2\times R_{B2}\leqq R_{T2}\leqq100\times R_{B2}.$$

6. An apparatus according to claim 1, wherein when primary image transfer and secondary image transfer are carried out substantially simultaneously, said first transfer means and said second transfer means are substantially simultaneously supplied with bias voltages, wherein the bias voltages is lower than a primary transfer bias voltage relative to said secondary opposite roller.

7. An apparatus according to claim 1, wherein a plurality of color toner images are sequentially transferred onto the intermediary transfer member from said first image bearing member, and the plurality of color toner images are altogether transferred onto the transfer material from the intermediary transfer member.

8. An image forming apparatus for forming a toner image on a transfer material using an intermediary transfer member, comprising:

an electrophotographic photosensitive member as a first image bearing member;

toner image forming means for sequentially forming color toner images on said image bearing member;

an intermediary transfer member, as a second image bearing member, movable along an endless path in contact with said first image bearing member;

first transfer means for sequentially transferring the color toner image from said first image bearing member onto the intermediary transfer member at a first transfer position of said intermediary transfer member;

second transfer means for transferring the color toner image from said intermediary transfer member onto the transfer material at a second transfer position of said intermediary transfer member;

wherein said intermediary transfer member comprises as a base material flexible rubber belt having a thickness of 0.5 to 3 mm, and an actual resistance $R_{B1}$ (Ohm) thereof and an electrostatic capacity $C_{B1}$ (F) satisfy:

$$R_{B1}<1/C_{B1}.$$

9. An apparatus according to claim 8, wherein the actual resistance satisfies:

$$1\times10^{7}\leqq R_{B1}\leqq 2\times10^{9}.$$

10. An apparatus according to claim 8, wherein said second transfer means comprises a secondary transfer roller and a secondary opposite roller which cooperate to nip said intermediary transfer member, and an actual resistance $R_{T2}$ (Ohm) of said secondary transfer roller satisfies:

$$1\times10^{4}\leqq R_{T2}\leqq 5\times10^{9}$$

when the transfer material is nipped between said intermediary transfer member and said secondary opposite roller.

11. An apparatus according to claim 8, wherein said second transfer means comprises a secondary transfer roller and a secondary opposite roller which cooperate to nip said intermediary transfer member, and an actual resistance $R_{T2}$ (Ohm) of said secondary transfer roller, an actual resistance $R_{B2}$ (Ohm) of said intermediary transfer member and an actual resistance of said secondary opposite roller $R_{A2}$ (Ohm) satisfy:

$$R_{T2}>R_{B2}>R_{A2}.$$

12. An apparatus according to claim 11, wherein the actual resistance $R_{T2}$ (Ohm) of said secondary transfer roller and the actual resistance $R_{B2}$ (Ohm) of the intermediary transfer member satisfy:

$$2\times R_{B2}\leqq R_{T2}\leqq 100\times R_{B2}.$$

13. An apparatus according to claim 8, wherein when primary image transfer and secondary image transfer are carried out substantially simultaneously, said first transfer means and said second transfer means are substantially simultaneously supplied with bias voltages, wherein the bias voltages is lower than a primary transfer bias voltage relative to said secondary opposite roller.

14. An image forming apparatus for forming a toner image on a transfer material using an intermediary transfer member, comprising:

an electrophotographic photosensitive member as a first image bearing member;

toner image forming means for sequentially forming color toner images on said image bearing member;

an intermediary transfer member, as a second image bearing member, movable along an endless path in contact with said first image bearing member;

first transfer means for sequentially transferring the color toner image from said first image bearing member onto the intermediary transfer member at a first transfer position of said intermediary transfer member;

second transfer means for transferring the color toner image from said intermediary transfer member onto the transfer material at a second transfer position of said intermediary transfer member;

wherein said intermediary transfer member comprises as a base material flexible rubber belt having a thickness of 0.5 to 3 mm, and an actual resistance $RB_1$ (Ohm) thereof and an electrostatic capacity $C_{B1}$ (F) satisfy:

$$R_{B1}<1/C_{B1};$$

and preferably $$1\times10^{7}\leqq R_{B1}\leqq 2\times10^{9};$$

wherein said second transfer means comprises a secondary transfer roller and a secondary opposite roller which cooperate to nip said intermediary transfer member, and an actual resistance $R_{T2}$ (Ohm) of said secondary transfer roller satisfies:

$$\times10^{4}\leqq R_{T2}\leqq 5\times10^{9}$$

when the transfer material is nipped between said intermediary transfer member and said secondary opposite roller.

15. An apparatus according to claim 14, wherein said second transfer means comprises a secondary transfer roller and a secondary opposite roller which cooperate to nip said intermediary transfer member, and an actual resistance $R_{T2}$ (Ohm) of said secondary transfer roller, an actual resistance $R_{B2}$ (Ohm) of said intermediary transfer member and an actual resistance of said secondary opposite roller $R_{A2}$ (Ohm) satisfy:

$$R_{T2}>R_{B2}>R_{A2}.$$

16. An apparatus according to claim 15, wherein an actual resistance $R_{T2}$ (Ohm) of said secondary transfer roller and the actual resistance $R_{B2}$ (Ohm) of the intermediary transfer member (Ohm) satisfy:

$$2\times R_{B2}\leqq R_{T2}\leqq 100\times R_{B2}.$$

17. An image forming apparatus for forming a toner image on a transfer material using an intermediary transfer member, comprising:

an electrophotographic photosensitive member as a first image bearing member;

toner image forming means for sequentially forming color toner images including yellow, cyan and magenta colors, on said image bearing member;

an intermediary transfer member, as a second image bearing member, movable along an endless path in contact with said first image bearing member;

first transfer means for sequentially transferring the color toner image from said first image bearing member onto the intermediary transfer member at a first transfer position of said intermediary transfer member;

second transfer means for transferring the color toner image from said intermediary transfer member onto the transfer material at a second transfer position of said intermediary transfer member;

wherein said intermediary transfer member comprises as a base material flexible rubber belt having a thickness of 0.5 to 3 mm, and an actual resistance $RB_1$ (Ohm) thereof and an electrostatic capacity $C_{B1}$ (F) satisfy:

$$R_{B1}<1/C_{B1};$$

and preferably $$1\times10^7 \leqq R_{B1} \leqq 2\times10^9;$$

wherein said second transfer means comprises a secondary transfer roller and a secondary opposite roller which cooperate to nip said intermediary transfer member, and an actual resistance $R_{T2}$ (Ohm) of said secondary transfer roller satisfies:

$$1\times10^4 \leqq R_{T2} \leqq 5\times10^9$$

when the transfer material is nipped between said intermediary transfer member and said secondary opposite roller.

* * * * *

UNITED STATES PATENT AND TRADEMARK OFFICE

CERTIFICATE OF CORRECTION

PATENT NO. : 5,809,387

DATED : September 15, 1998

INVENTOR(S) : AKIHIKO TAKEUCHI, ET AL.

It is certified that error appears in the above-identified patent and that said Letters Patent is hereby corrected as shown below:

COLUMN 4,
Line 52, "$R_{R1}<1<C_{B1}$" should read --$R_{B1}<1<C_{B1}$--.

COLUMN 5,
Line 12, "drawings" should read --drawings.--.

COLUMN 7,
Line 15, to" should be deleted;
Line 46, "50-200 μm" should read --50-200 μm,--; and
Line 47, "an" should be deleted.

COLUMN 9,
Line 59, "$104^4$ Ω.cm" should read --104 Ω.cm--.

COLUMN 11,
Line 23, "$2x10^7\Omega$" should read --$2x10^9\Omega$--.

COLUMN 13,
Line 54, "inequality:" should read --equation:--.

COLUMN 14,
Line 18, "member;" should read --member; and--.

COLUMN 15,
Line 1, "is" should read --are--; and
Line 22, "member;" should read --member; and--.

UNITED STATES PATENT AND TRADEMARK OFFICE

CERTIFICATE OF CORRECTION

PATENT NO. : 5,809,387

DATED : September 15, 1998

INVENTOR(S) : AKIHIKO TAKEUCHI, ET AL.

It is certified that error appears in the above-identified patent and that said Letters Patent is hereby corrected as shown below:

COLUMN 16,
Line 4, "is" should read --are--;
Line 19, "member;" should read --member; and--; and
Line 41, "$x10^4 \leq R_{T2} \leq 5x10^9$" should read --$1x10^4 \leq R_{T2} \leq 5x10^9$--.

COLUMN 17,
Line 10, "member;" should read --member; and--.

Signed and Sealed this

Twenty-second Day of June, 1999

*Attest:*

Q. TODD DICKINSON

*Attesting Officer*

*Acting Commissioner of Patents and Trademarks*